US011742598B2

(12) United States Patent
Chang et al.

(10) Patent No.: US 11,742,598 B2
(45) Date of Patent: Aug. 29, 2023

(54) ELECTRICAL CONNECTOR

(71) Applicant: Advanced Connectek Inc., New Taipei (TW)

(72) Inventors: Ming-Yung Chang, New Taipei (TW); Tzu Hao Li, New Taipei (TW); Chia Cheng He, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 66 days.

(21) Appl. No.: 17/504,532

(22) Filed: Oct. 19, 2021

(65) Prior Publication Data

US 2022/0123483 A1 Apr. 21, 2022

(30) Foreign Application Priority Data

Oct. 21, 2020 (TW) ..... 109213818

(51) Int. Cl.
*H01R 4/02* (2006.01)
*H01R 24/20* (2011.01)
*H01R 105/00* (2006.01)

(52) U.S. Cl.
CPC ..... *H01R 4/023* (2013.01); *H01R 24/20* (2013.01); *H01R 2105/00* (2013.01)

(58) Field of Classification Search
CPC ..... H01R 4/023; H01R 4/022; H01R 4/021; H01R 4/02; H01R 24/20; H01R 2105/00
See application file for complete search history.

(56) References Cited

U.S. PATENT DOCUMENTS

| | | | | |
|---|---|---|---|---|
| 6,368,155 | B1 * | 4/2002 | Bassler | H01R 13/6625 439/620.21 |
| 6,390,852 | B1 * | 5/2002 | Wang | H01R 13/6593 439/96 |
| 8,956,167 | B2 * | 2/2015 | Wu | H01R 13/6471 439/98 |
| 9,033,744 | B2 * | 5/2015 | Chen | H01R 12/721 439/660 |
| 9,385,438 | B2 * | 7/2016 | Wu | H01R 4/023 |
| 9,478,925 | B2 * | 10/2016 | Wu | H01R 43/0249 |
| 9,520,673 | B2 * | 12/2016 | Xing | B29C 70/84 |
| 9,692,161 | B2 * | 6/2017 | Lindkamp | H01R 12/75 |
| 2008/0305651 | A1 * | 12/2008 | Mostoller | H01R 4/188 439/85 |
| 2013/0078858 | A1 * | 3/2013 | Wu | H01R 13/6592 439/607.41 |

(Continued)

FOREIGN PATENT DOCUMENTS

JP 2009-266609 * 11/2009

*Primary Examiner* — Harshad C Patel
(74) *Attorney, Agent, or Firm* — JCIPRNET

(57) ABSTRACT

An electrical connector for soldering with a cable is provided. The electrical connector includes an insulating body, a plurality of terminals, and a metallic shell. The terminals are disposed in the insulating body and arranged in a lateral direction. Each of the terminals has a clip section, a connecting section, and a soldering section. The metallic shell is assembled to the insulating body to form an interface of the electrical connector for connecting to another electrical connector, the clip section is close to the interface, the soldering section is away from the interface, and the cable is soldered to the soldering section of at least one of the terminals in the lateral direction.

20 Claims, 4 Drawing Sheets

(56) References Cited

U.S. PATENT DOCUMENTS

| | | | | |
|---|---|---|---|---|
| 2016/0013566 | A1* | 1/2016 | Wu | H01R 4/023<br>439/676 |
| 2016/0141817 | A1* | 5/2016 | Wu | H01R 24/60<br>439/676 |

* cited by examiner

ELECTRICAL CONNECTOR

CROSS-REFERENCE TO RELATED APPLICATION

This application claims the priority benefit of Taiwan application serial no. 109213818, filed on Oct. 21, 2020. The entirety of the above-mentioned patent application is hereby incorporated by reference herein and made a part of this specification.

BACKGROUND

Technical Field

The disclosure relates to an electrical connector.

Description of Related Art

As electronic devices are gradually moving towards miniaturization, the space available for discharging connectors inside a device has gradually become narrower so that it can be adapted to the limited miniaturized space, and the adapted corresponding electrical connector also needs to move towards the design of miniaturization.

However, since with the existing wiring method, the adapted electrical connector is still in a direction consistent with the direction of the insertion axis, its length cannot be effectively shortened. Therefore, the design demand for an electrical connector with a miniaturized structure without affecting its electrical connection relationship arises.

SUMMARY

The disclosure provides an electrical connector in which the cable is soldered to the terminal laterally so that the size of the electrical connector is effectively reduced.

The electrical connector in the disclosure is adapted for soldering with a cable. The electrical connector includes an insulating body, multiple terminals, and a metallic shell. The terminals are arranged in a lateral direction and disposed in the insulating body. Each of the terminals includes a clip section, a connecting section, and a soldering section. The metallic shell is assembled to the insulating body to form an interface for connecting to another electrical connector. The clip section is close to the interface, and the soldering section is away from the interface. The cable is soldered to the soldering section of at least one of the terminals in the lateral direction.

The electrical connector in the disclosure is adapted for soldering with a cable. The electrical connector includes an insulating body, multiple terminals, and a metallic shell. The terminals are arranged in a lateral direction and disposed in the insulating body. Each of the terminals includes a clip section, a connecting section, and a soldering section. The clip section, the connecting section and the soldering section of each terminal are extended along an insertion axis, the connecting section of each terminal is an elongated thin flat plate and has a height along a vertical direction, and the vertical direction is substantially orthogonal to the lateral direction and the insertion direction. The metallic shell is assembled to the insulating body to form an interface for plugging into another electrical connector, wherein the clip section is close to an insertion opening of the interface, and the soldering section is away from the insertion opening of the interface, wherein the cable is soldered to the soldering section of at least one of the terminals along the lateral direction.

The electrical connector in the disclosure is adapted for soldering with a cable. The electrical connector includes an insulating body, multiple terminals, and a metallic shell. The terminals are arranged in a lateral direction and disposed in the insulating body. Each of the terminals includes a clip section, a connecting section, and a soldering section. The clip section, the connecting section and the soldering section of each terminal are extended along an insertion axis, the connecting section of each terminal is an elongated thin flat plate and has a height along a vertical direction, and the vertical direction is substantially orthogonal to the lateral direction and the insertion direction. The soldering section comprises a first bending section extended from the connecting section along the lateral direction, and a second bending section extended from the first bending section along the vertical direction. The metallic shell is assembled to the insulating body to form an interface for plugging into another electrical connector, wherein the clip section is close to an insertion opening of the interface, and the soldering section is away from the insertion opening of the interface.

In an embodiment of the disclosure, the lateral direction and the direction of a insertion axis of the electrical connector are not parallel to each other.

In an embodiment of the disclosure, the lateral direction is orthogonal to the direction of a insertion axis of the electrical connector.

In an embodiment of the disclosure, the soldering section is bent twice relative to the connecting section.

In an embodiment of the disclosure, the cable includes one power wire and two ground wires.

In an embodiment of the disclosure, the terminals include a pair of power terminals and a pair of ground terminals, the power terminals are located between the ground terminals, the power terminals are soldered to the power wire, and the ground terminals are respectively soldered to the ground wires.

In an embodiment of the disclosure, the terminals have the same bending structure.

In an embodiment of the disclosure, the terminals include a pair of power terminals and a pair of ground terminals, one of the power terminals and one of the ground terminals are disposed in the insulating body in the same configuration direction, another power terminal and another ground terminal are disposed in the insulating body in another configuration direction, and the difference between the two configuration directions is that the terminals rotate 180 degrees in the direction of a insertion axis of the electrical connector.

In an embodiment of the disclosure, the soldering section is bent relative to the connecting section to form a plane, the interface is located on another plane, and the two planes are parallel to each other.

In an embodiment of the disclosure, the soldering section is bent relative to the connecting section to form a plane, the terminals are located on another plane, and the two planes are orthogonal to each other.

In an embodiment of the disclosure, the soldering section comprises a first bending section extended from the connecting section, and a second bending section extended from the first bending section.

In an embodiment of the disclosure, the soldering section is substantially bent twice respective to the connecting section, and the second bending section is separated from the connecting section.

In an embodiment of the disclosure, the first bending section is extended from the connecting section along the lateral direction and the second bending section is extended from the first bending section along a vertical direction substantially orthogonal to the lateral direction and the insertion direction.

In an embodiment of the disclosure, the clip section is extended from the connecting section to form two contact heads and the two contact heads are separated along the vertical direction.

Based on the above, in the electrical connector adapted for soldering to the cable, by dividing the terminals of the electrical connector into an clip section, a connecting section, and a soldering section, the soldering section of each terminal allows the cable to be soldered to the corresponding terminal in the lateral direction. Also, the lateral direction is the arrangement direction of the terminals. Accordingly, with the soldering process in the lateral direction, the size of the electrical connector along its direction of the insertion axis is effectively reduced and its function of proper electrical connection is maintained, so that the electrical connector conforms to the feature of miniaturized structure.

DESCRIPTION OF THE EMBODIMENTS

Figure 1A:
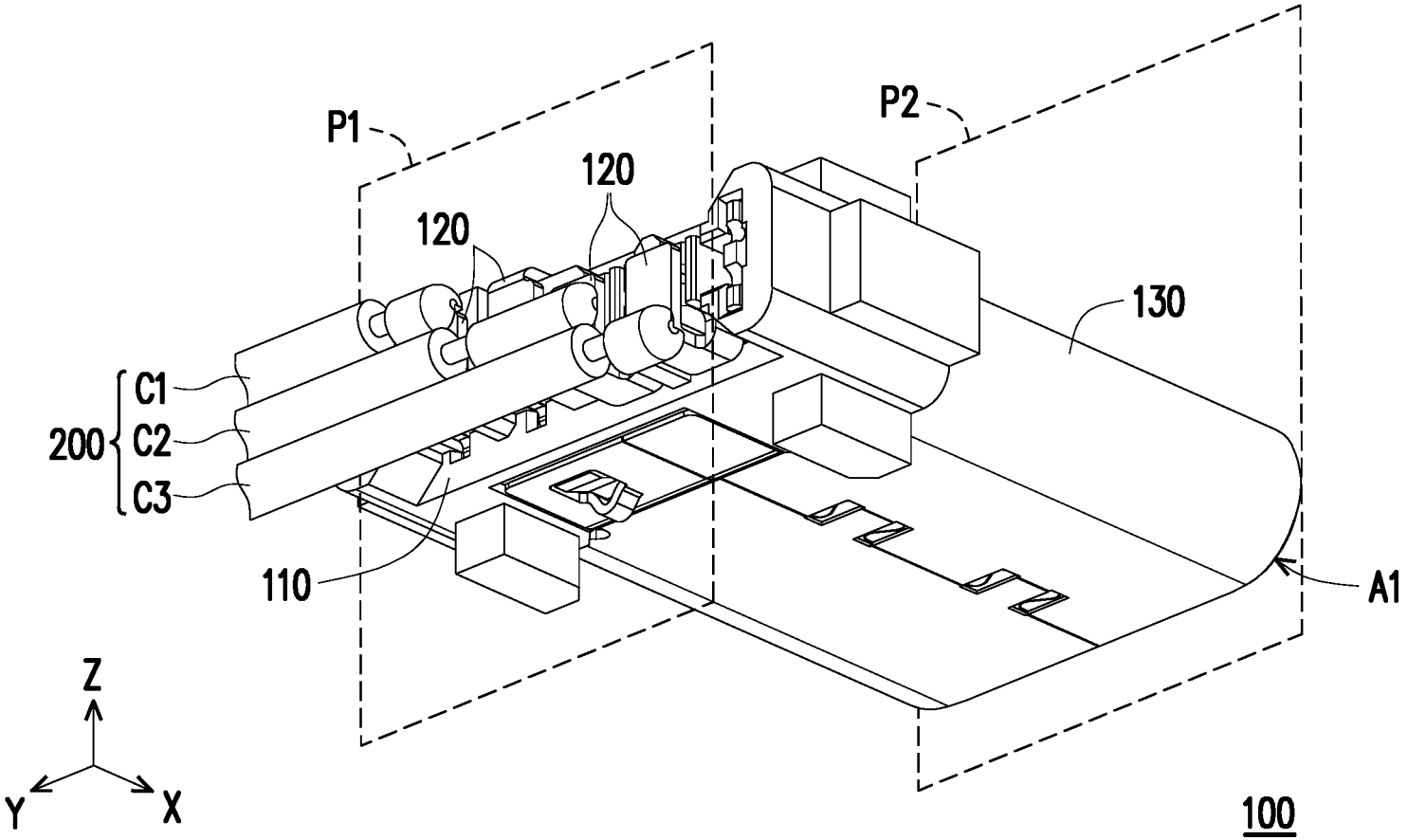
FIG. 1A is a schematic view of an electrical connector according to an embodiment of the disclosure.
Figure 1B:
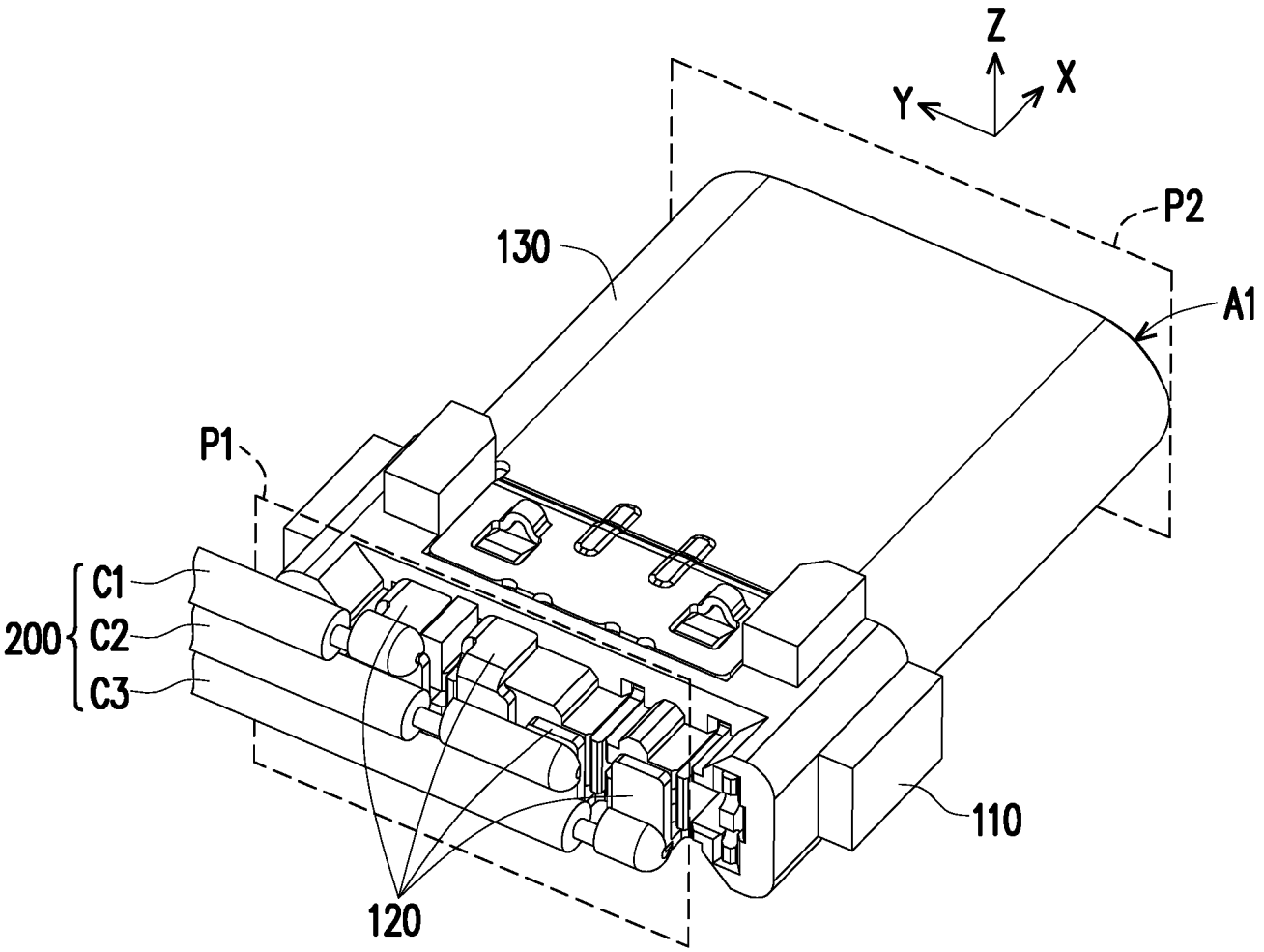
FIG. 1B illustrates the electrical connector of FIG. 1A from another perspective.
Figure 2:
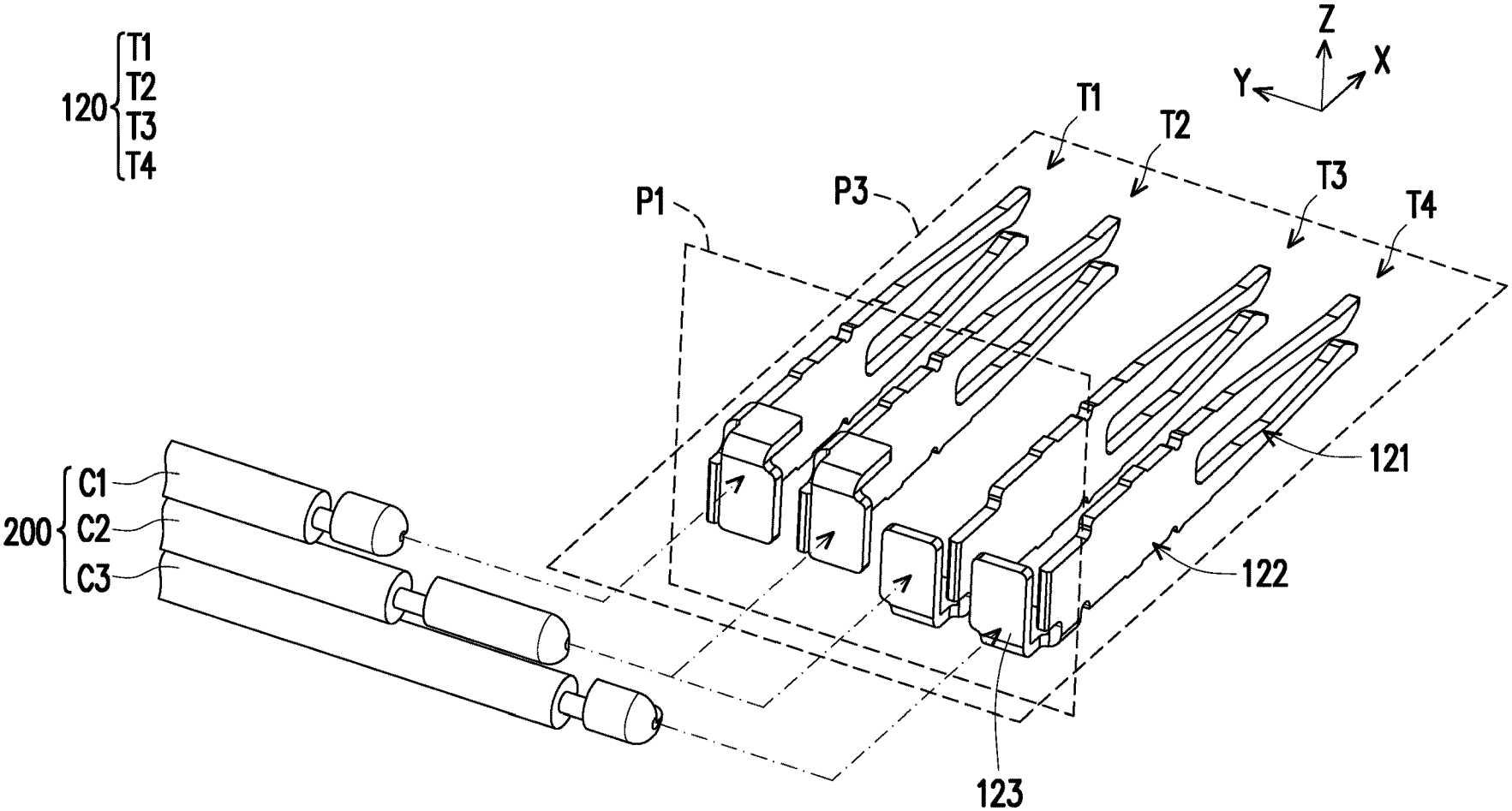
FIG. 2 is a schematic view of the assembling of some elements of the electrical connector of FIG. 1A and FIG. 1B.

FIG. 1A is a schematic view of an electrical connector according to an embodiment of the disclosure. FIG. 1B illustrates the electrical connector of FIG. 1A from another perspective. FIG. 2 is a schematic view of the assembling of some elements of the electrical connector of FIGS. 1A and 1B. Meanwhile, a Cartesian coordinate X-Y-Z is provided to facilitate the description of elements. Refer to FIG. 1A, FIG. 1B, and FIG. 2 altogether. In the embodiment, an electrical connector 100 is adapted for soldering with a cable 200. The electrical connector 100 includes an insulating body 110, multiple terminals 120, and a metallic shell 130. The terminals 120 are arranged in a lateral direction and are disposed in the insulating body 110. Each of the terminals 120 has an clip section 121, a connecting section 122, and a soldering section 123. The metallic shell 130 is assembled to the insulating body 110 to form an interface A1 for connecting to another electrical connector (not shown). The interface A1 includes an insertion opening and an insertion cavity. For the terminal 120, the clip section 121 is close to the insertion opening of the interface A1, the soldering section 123 is away from the insertion opening of the interface A1, and the cable 200 is soldered to the soldering section 123 of at least one of the terminals 120 in the lateral direction. The clip section 121, the connecting section 122, and the soldering section 123 of each terminal 120 are extended along an insertion axis, i.e. the X axis. The connecting section 122 of each terminal 120 is an elongated thin flat plate and has a height along a vertical direction, i.e. the Z axis. The clip section 121 is extended from the connecting section 122 to form two contact heads. The two contact heads are separated along the vertical direction.

Furthermore, the metallic shell 130 is disposed around the insulating body 110 to cover a part of the insulating body 110 and a part of the terminals 120, and the insertion opening of the interface A1 is located on a plane P2. Here, the electrical connector 100 uses the X axis as its direction of the insertion axis, and the insertion opening of the interface A1 is located on the Y-Z plane. Accordingly, the terminals 120 of the embodiment are arranged along the Y axis, that is, the lateral direction, so the lateral direction and the direction of the insertion axis of the electrical connector 100 are not parallel to each other. In other words, the lateral direction is perpendicular to the direction of the insertion axis of the electrical connector 100. More specifically, the lateral direction is substantially orthogonal to the direction of the insertion axis of the electrical connector 100.

Figure 3:
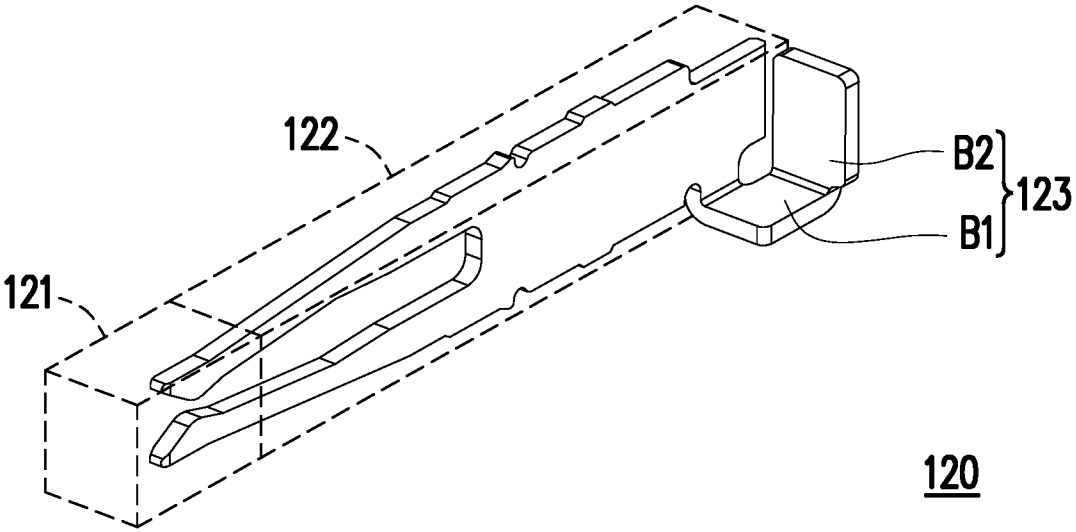
FIG. 3 is a schematic view of one of the terminals of the electrical connector of FIG. 1A.

Furthermore, as shown in FIG. 2, to effectively shorten the length of the electrical connector 100, that is, to reduce the size of the electrical connector 100 along the X axis, the cable 200 of the embodiment needs to be soldered to the soldering section 123 of the terminal 120 in the lateral direction. In detail, FIG. 3 is a schematic view of one of the terminals of the electrical connector of FIG. 1A. Refer to both FIG. 2 and FIG. 3. In the embodiment, the terminal 120 includes power terminals T2 and T3 and ground terminals T1 and T4. The cable 200 includes at least one power wire C2 and at least one ground wire (one power wire C2 and two ground wires C1 and C3 are illustrated in the embodiment). Accordingly, the power wire C2 is correspondingly soldered to the power terminals T2 and T3, and the ground wires C1 and C3 are respectively and correspondingly soldered to the ground terminals T1 and T4.

From FIG. 3, it is known that the terminals 120 are made from a conductive metal plate by stamping and bending. In particular, to facilitate both the manufacturing process and the subsequent improvement of the combination with the insulating body 110, the clip section 121 and the connecting section 122 in the embodiment are substantially located in the same axial direction, and the main plane of the soldering section 123 deviates from the axial direction where the clip section 121 and the connecting section 122 are located. Meanwhile, the soldering section 123 includes a first bending section B1 extended from the connecting section 122 along the lateral direction, and a second bending section B2 extended from the first bending section B1 along the vertical direction. That is, the soldering section 123 is substantially bent twice respective to the connecting section 122, and the second bending section B2 may be regarded as being separated from the connecting section 122. The soldering section 123 is in the lateral direction, and the soldering section 123 and the connecting section 122 are not parallel to each other.

Furthermore, refer to both FIG. 2 and FIG. 3 to clearly understand that the four terminals 120 of the electrical connector 100 in the embodiment are formed in a single terminal structure. That is, the terminals 120 have the same bending structure. Therefore, during manufacturing, the terminals 120 of the same structure and shape are manufactured, and the four terminals 120 of the same structure are arranged and combined to form the electrical connector 100. In order to allow the four terminals 120 to be arranged together smoothly, the power terminal T2 and the ground terminal T1 are disposed in the insulating body 110 in the same configuration direction, and the power terminal T3 and the ground terminal T4 are disposed in the insulating body 110 in another configuration direction. The difference between the two configuration directions is that the terminals 120 rotate 180 degrees in the direction of the insertion axis (i.e., the X axis) of the electrical connector 100. For example, the soldering sections 123 of the power terminal T2 and the ground terminal T1 are bent from top to bottom, while the soldering sections 123 of the power terminal T3 and the ground terminal T4 are bent from bottom to top.

In addition, refer to both FIG. 1B and FIG. 2. Each soldering section 123 of the terminals 120 in the embodiment is bent from the connecting section 122 to form multiple planes, the planes are located on a plane P1, the interface A1 is located on a plane P2, and the terminals 120 are also located on a plane P3. The plane P1 is orthogonal to the plane P3, and the plane P1 is parallel to the plane P2. However, the bending angle of the soldering section 123 is not limited in the disclosure. That is, in other embodiments not shown, as long as the second bending section B2 of the soldering section 123 as shown in FIG. 3 is not parallel to the plane P3 and not orthogonal to the plane P2, the cable 200 is soldered to the soldering section 123 in the lateral direction. On the other hand, in the embodiment, the soldering direction of the cable 200 is not limited thereto. Taking FIG. 2 as an example, the cable 200 is soldered to the terminal 120 from left to right. In other embodiments not shown, the cable 200 in FIG. 2 may also be soldered in a direction from top to bottom, from right to left, or from bottom to top. In other words, as long as the cable 200 is soldered on the plane P1 where the second bending sections B2 of the soldering sections 123 of the terminals 120 are located, the effect of soldering in the lateral direction is achieved.

Based on the above, in the embodiment of the disclosure, by dividing the terminals of the electrical connector into an clip section, a connecting section, and a soldering section, the soldering section of each terminal allows the cable to be soldered to the corresponding terminal in the lateral direction. Also, the lateral direction is the arrangement direction of the terminals. Accordingly, with the soldering process in the lateral direction, the size of the electrical connector along its direction of the insertion axis is effectively reduced and its function of proper electrical connection is maintained, so that the electrical connector conforms to the feature of miniaturized structure.

Furthermore, the terminals of the electrical connector have the same structure and shape, that is, the terminals are made from the same conductive metal plate by stamping and bending. The first bending section is extended from the connecting section, and then the second bending section is extended, so that the four terminals of the electrical connector are formed with terminals of the same structure in different configuration directions, and the cable is soldered to the second bending sections in the lateral direction. Accordingly, in manufacturing the electrical connector, only terminals of a single specification are needed, which effectively simplifies the manufacturing process and reduces the manufacturing cost.

What is claimed is:

1. An electrical connector for soldering with a cable, comprising:

an insulating body;

a plurality of terminals arranged in a lateral direction and disposed in the insulating body, wherein each of the terminals comprises a clip section, a connecting section, and a soldering section; and a metallic shell assembled to the insulating body to form an interface for plugging into another electrical connector, wherein the clip section is close to an insertion opening of the interface, and the soldering section is away from the insertion opening of the interface, wherein the cable is soldered to the soldering section of at least one of the terminals in the lateral direction.

2. The electrical connector according to claim 1, wherein the lateral direction and a direction of an insertion axis of the electrical connector are not parallel to each other.

3. The electrical connector according to claim 1, wherein the lateral direction is orthogonal to a direction of an insertion axis of the electrical connector.

4. The electrical connector according to claim 1, wherein the soldering section is bent twice relative to the connecting section.

5. The electrical connector according to claim 1, wherein the cable comprises at least one power wire and at least one ground wire.

6. The electrical connector according to claim 5, wherein the plurality of the terminals comprise a pair of power terminals and a pair of ground terminals, the pair of the power terminals are located between the pair of the ground terminals, the pair of the power terminals are soldered to the power wire, and the pair of the ground terminals are respectively soldered to the pair of the ground wires.

7. The electrical connector according to claim 1, wherein the plurality of the terminals comprise a same bending structure.

8. The electrical connector according to claim 7, wherein the plurality of the terminals comprise a pair of power terminals and a pair of ground terminals, one of the power terminals and one of the ground terminals are disposed in the insulating body in one configuration direction, another power terminal and another ground terminal are disposed in the insulating body in another configuration direction, and the difference between the two configuration directions is that the terminals rotate 180 degrees in a direction of an insertion axis of the electrical connector.

9. The electrical connector according to claim 1, wherein the soldering section is bent relative to the connecting section to form a plane, the interface is located on another plane, and the two planes are parallel to each other.

10. The electrical connector according to claim 1, wherein the soldering section is bent relative to the connecting section to form a plane, the plurality of the terminals are all located on another plane, and the two planes are orthogonal to each other.

11. The electrical connector according to claim 1, wherein the soldering section is in the lateral direction, and the soldering section and the connecting section are not parallel to each other.

12. The electrical connector according to claim 1, wherein the soldering section comprises a first bending section extended from the connecting section, and a second bending section extended from the first bending section.

13. The electrical connector according to claim 12, wherein the soldering section is substantially bent twice respective to the connecting section, and the second bending section is separated from the connecting section.

14. The electrical connector according to claim 12, wherein the first bending section is extended from the connecting section along the lateral direction and the second bending section is extended from the first bending section along a vertical direction substantially orthogonal to the lateral direction and the insertion direction.

15. An electrical connector for soldering with a cable, comprising:

an insulating body;

a plurality of terminals arranged in a lateral direction and disposed in the insulating body, wherein each of the terminals comprises a clip section, a connecting section, and a soldering section, the clip section, the connecting section and the soldering section of each terminal are extended along an insertion axis, the connecting section of each terminal is an elongated thin flat plate and has a height along a vertical direction, and the vertical direction is substantially orthogonal to the lateral direction and the insertion direction; and a metallic shell assembled to the insulating body to form an interface for plugging into another electrical connector, wherein the clip section is close to an insertion opening of the interface, and the soldering section is away from the insertion opening of the interface, wherein the cable is soldered to the soldering section of at least one of the terminals along the lateral direction.

16. The electrical connector according to claim 15, wherein the clip section is extended from the connecting section to form two contact heads and the two contact heads are separated along the vertical direction.

17. The electrical connector according to claim 15, wherein the soldering section comprises a first bending section extended from the connecting section, and a second bending section extended from the first bending section.

18. The electrical connector according to claim 17, wherein the soldering section is substantially bent twice respective to the connecting section, and the second bending section is separated from the connecting section.

19. The electrical connector according to claim 17, wherein the first bending section is extended from the connecting section along the lateral direction and the second bending section is extended from the first bending section along the vertical direction.

20. An electrical connector for soldering with a cable, comprising:

an insulating body;

a plurality of terminals arranged in a lateral direction and disposed in the insulating body, wherein each of the terminals comprises a clip section, a connecting section, and a soldering section, the clip section, the connecting section and the soldering section of each terminal are extended along an insertion axis, the connecting section of each terminal is an elongated thin flat plate and has a height along a vertical direction, and the vertical direction is substantially orthogonal to the lateral direction and the insertion direction, wherein the soldering section comprises a first bending section extended from the connecting section along the lateral direction, and a second bending section extended from the first bending section along the vertical direction; and a metallic shell assembled to the insulating body to form an interface for plugging into another electrical connector, wherein the clip section is close to an insertion opening of the interface, and the soldering section is away from the insertion opening of the interface.

* * * * *